US008519606B2

(12) United States Patent
Suzuki et al.

(10) Patent No.: US 8,519,606 B2
(45) Date of Patent: Aug. 27, 2013

(54) SPARK PLUG FOR INTERNAL COMBUSTION ENGINE AND METHOD OF MANUFACTURING SPARK PLUG

(75) Inventors: Akira Suzuki, Nagoya (JP); Mai Nakamura, Inazawa (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 26 days.

(21) Appl. No.: 13/392,351

(22) PCT Filed: Jun. 23, 2010

(86) PCT No.: PCT/JP2010/060624

§ 371 (c)(1),
(2), (4) Date: Feb. 24, 2012

(87) PCT Pub. No.: WO2011/024548

PCT Pub. Date: Mar. 3, 2011

(65) Prior Publication Data

US 2012/0146484 A1 Jun. 14, 2012

(30) Foreign Application Priority Data

Aug. 26, 2009 (JP) ..... 2009-194995

(51) Int. Cl.
*H01T 13/20* (2006.01)
*H01T 21/02* (2006.01)

(52) U.S. Cl.
USPC ..... 313/141; 313/143; 445/7

(58) Field of Classification Search
USPC ..... 313/118, 141–143; 123/143, 169 R; 445/7; 219/121.64
See application file for complete search history.

(56) References Cited

U.S. PATENT DOCUMENTS 7,164,225 B2 * 1/2007 Yoshimoto et al. ..... 313/141
2003/0168955 A1 * 9/2003 Suzuki ..... 313/143

FOREIGN PATENT DOCUMENTS

JP 4510846 B1 4/1970
JP 2003257583 A 9/2003
JP 2003-332021 A 11/2003

OTHER PUBLICATIONS

International Search Report (PCT/ISA/210) issued on Sep. 28, 2010 in the International Patent Application No. PCT/JP2010/060624.
Written Opinion (PCT/ISA/237) issued on Sep. 28, 2010 in the International Patent Application No. PCT/JP2010/060624.

* cited by examiner

*Primary Examiner* — Anh Mai
*Assistant Examiner* — Elmito Breval
(74) *Attorney, Agent, or Firm* — Sughrue Mion, PLLC

(57) ABSTRACT

A spark plug (1) includes an insulator (2) and a metal shell (3), including a middle section (41) positioned between a collar section (16) and a tool engaging section (19). The middle section (41) has a bulged section (42), a first slender section (43) and a second slender section (44) that is the most slender at a portion positioned further to the leading end side than the bulged section (42). In a cross-section including the axis CL1, when the distance between both slender sections (43) and (44) along the axis CL1 is F (mm) and the bulged amount to the inside in diametrical direction of a most bulged section (42M) with respect to an imaginary line that connects a portion that is positioned furthest to the inside in diametrical direction of both slender sections 43 and 44 is G (mm), the relationship $0.00<G/F\leqq 0.18$ is satisfied.

15 Claims, 6 Drawing Sheets

SPARK PLUG FOR INTERNAL COMBUSTION ENGINE AND METHOD OF MANUFACTURING SPARK PLUG

TECHNICAL FIELD

The present invention relates to a spark plug that is used with an internal combustion engine and a method of manufacturing the spark plug.

BACKGROUND ART

The spark plug is attached to an internal combustion engine for example, and is used to ignite a mixture within a combustion chamber. Generally, the spark plug includes an insulating body that has an axial hole, a center electrode that passes through a leading end side of the axial hole, a metal shell that is provided at the outer periphery of the insulating body and a ground electrode that is provided at the leading end section of the metal shell and forms a spark discharge distance between the center electrode and ground electrode. Also, generally, the metal shell includes a tool engaging section in which a tool or the like is engaged when the metal shell is attached to the internal combustion engine or the like and a seat section that is attached with respect to the engine head of the internal combustion engine directly or indirectly through a gasket or the like.

However, the metal shell and the insulating body are fixed by clamping and then assembled. More specifically, in a case where the insulating body is inserted into the cylindrical metal shell, a load is applied with respect to a rear end side opening of the metal shell along the axial direction by a circular mold. Thus, the rear end side opening of the metal shell is bent to the inside in the diametrical direction and becomes a clamping section that is engaged to a large diameter section that bulges to the outside in the diametrical direction in the insulating body, and the metal shell and the insulating body are assembled.

Also, as a method of fixing in clamping, so-called clamping by heat is known (for example, see Patent document 1). In other words, while the load is applied by the mold, the metal shell is heated by electrical conduction through the mold and a relatively slender middle section that is positioned between the tool engaging section of the metal shell and the seat section is heated. Thus, when the deformation resistance of the middle section is small, the middle section is by the load and buckles inward. After that, the middle section that is in a heat expansion state is cooled and contracted so that the clamping section of the metal shell becomes in an strongly engaged state with respect to the large diameter section of the insulating body; and the insulating body and the metal shell are strongly assembled.

RELATED ART DOCUMENT

Patent Document

[Patent document 1] Japanese Patent Publication No. 2003-332021-A

SUMMARY OF INVENTION

Problem that the Invention is to Solve

However, since stress accompanying the contraction remains in the middle section, a stress corrosion cracking is generated at the middle section according to the use of the spark plug and there is a concern that the airtightness and durability will be damaged. The stress corrosion cracking may be generated by corrosion at the inner periphery of the middle section due to a dew condensation. Inventor of the invention closely observed the cause of the generation of stress corrosion cracking at the inner periphery portion of the middle section and recognized that a portion (recess section) is formed on the inner periphery of the middle section so as to recessed toward the outside in the diametrical direction according to the clamping process. In other words, the stress is concentrated at the recess section and as a result stress corrosion cracking is generated. As a result of further review by the inventor of the invention, it became clear that the recess section is formed when the middle section has a bulged shape to the outside only in the diametrical direction according to the clamping process.

An advantage of some aspects of the invention is to provide a spark plug and a method of manufacturing the spark plug in which the middle section bulges toward both the inside and the outside in the diametrical direction so that the formation of the recess section can be prevented and the generation of stress corrosion cracking is further reliably prevented in the middle section.

Means for Solving the Problem

Hereinafter, each of the configurations that are applied to solve the above-described problems is described. A specific operation effect corresponding to the configurations will be described when description of the effect is needed.

Configuration 1

A spark plug for an internal combustion engine comprising: a cylindrical insulating body that extends in an axis direction; and a cylindrical metal shell that is fixed on an outer periphery of the insulating body, wherein the metal shell including: a collar section that bulges toward an outside of a diametrical direction, a tool engaging section to which a tool is engaged to attach the metal shell to the internal combustion engine, and a middle section that is positioned between the collar section and the tool engaging section, wherein the middle section has a bulged section that bulges toward both an inside and the outside in the diametrical direction, wherein the middle section has a first slender section that is a portion that is positioned at further rear end side in the axis direction than the bulged section and is a section that is the most slender in the portion, and a second slender section that is a portion that is positioned at further leading end side in the axis direction than the bulged section of the middle section and is a section that is the most slender in the portion, wherein the bulged section has a most bulged section that is a portion that bulges furthest to the inside in the diametrical direction, wherein in a cross-section including the axis, assuming that F (mm) is a distance between the first slender section and the second slender section along the axis, and G (mm) is a bulged amount toward the inside in diametrical direction of the most bulged section with respect to an imaginary line that connects a portion that is positioned furthest to the inside in the diametrical direction of the first slender section and a portion that is positioned furthest to the inside in the diametrical direction of the second slender sections, following formula (1) is satisfied. $0.00<G/F\leqq 0.18$ . . . (1)

According to the above-described configuration 1, since the middle section has a shape that bulges toward the inside in the diametrical direction, the formation of the recess section can be suppressed in the inner periphery portion and the generation of stress corrosion cracking is further reliably prevented in the inner periphery portion of the middle section.

Meanwhile, $G/F\leqq 0.18$ so that the bulged section of the middle section is prevented from excessively bulging toward the inside in the diametrical direction with respect to the length of the middle section along the axis. Accordingly, an extreme increase of the contraction stress that is applied to the middle section can be suppressed and the generation of stress corrosion cracking can be further suppressed.

Also, the bulged section is required such that the recess section that can be a starting point of stress corrosion cracking in the inner periphery portion is not formed. Accordingly, as shown in FIG. 6, even if a bulged section 71 bulges toward both the inside and the outside in the diametrical direction, it is not preferable that a recess section 72 is formed in the inner periphery portion.

Configuration 2

The spark plug for the internal combustion engine according to the configuration 1, wherein $0.00<G/F\leqq 0.15$ is satisfied.

According to the above-described configuration 2, the increase of the contraction stress that is applied to the middle section can be further suppressed and the generation of stress corrosion cracking can be further suppressed in the middle section.

Configuration 3

The spark plug for the internal combustion engine according to the configuration 1 or 2, wherein assuming that E1 (Hv) is a Vickers hardness of the first slender section, E2 (Hv) is a Vickers hardness of the second slender section and E3 (Hv) is a Vickers hardness of the most bulged section, any one of following formulas (2) and (3) is satisfied.

$$20\leqq|E1-E3| \quad (2)$$

$$20\leqq|E2-E3| \quad (3)$$

The middle section is cooled after being heated by the electrical conduction, however the middle section is in a state that quenching and annealing are performed according to the cooling condition, as a result, there is concern that a hardness difference may be generated at each of the middle sections. In a case where a relatively large hardness difference is generated at the middle sections, since the stress is concentrated at the place at which the hardness difference is generated, stress corrosion cracking may be further easily generated.

With respect to this, according to the above-described configuration 3, in a case where there is relatively large hardness difference such as 20 Hv or more between the most bulged section and the first and the second slender sections, there is concern that stress corrosion cracking will be further generated, however even in a condition that stress corrosion cracking is easily generated in view of the hardness difference, generation of stress corrosion cracking can be effectively suppressed by employing the configuration 1 or the like. In other words, the configuration 1 or the like is specifically significant in a case where a relatively large hardness difference can be generated at the middle section.

Configuration 4

The spark plug for the internal combustion engine according to any one of configuration 1 to 3, wherein in a cross-section that is orthogonal to the axis, assuming that a cross-sectional area of a smaller side in a cross-sectional area of the first slender section and a cross-sectional area of the second slender section is H ($mm^2$), $H\leqq 35$.

A predetermined value or more of the contraction stress is required to remain so as to sufficiently secure the airtightness between the metal shell and the insulation body. However in recent years, there has been a demand for a small diameter in spark plugs so that the cross-sectional area of the middle section becomes relatively smaller in accordance to the small diameter of the spark plug. When the cross-sectional area of the middle section becomes small, the applied stress per unit cross-sectional area becomes large and stress corrosion cracking may be further easily generated.

With respect to this, according to the above-described configuration 4, since the cross-sectional area of the smaller side in the cross-sectional area of the first slender section and the cross-sectional area of the second slender section (in other words, the cross-sectional area of the thinnest-walled section in the middle sections) is relatively small, such as 35 $mm^2$ or more, there is a concern that stress corrosion cracking will be further generated, however the concern can be dispelled by employing the configuration 1 or the like. In other words, the configuration 1 or the like is specifically significant in a case where the middle section is formed to be relatively slender. Also, the configuration 1 or the like is effectively operated, as the middle section is slender according to below described configurations 5 to 7.

Configuration 5

The spark plug for the internal combustion engine according to the configuration 4, wherein $H\leqq 31.2$.

According to the above-described configuration 5, the cross-sectional area of the most slender section in the middle sections becomes 31.2 $mm^2$ and there is concern that stress corrosion cracking will be further generated, however the generation of stress corrosion cracking can be effectively suppressed by employing the configuration 1 or the like.

Configuration 6

The spark plug for the internal combustion engine according to the configuration 4, wherein $H\leqq 26.4$.

According to the above-described configuration 6, there is a concern that stress corrosion cracking will be further generated; however the generation of stress corrosion cracking can be remarkably effectively suppressed by employing the configuration 1 or the like.

Configuration 7

The spark plug for the internal combustion engine according to the configuration 4, wherein $H\leqq 19.4$.

As in the configuration 7, even in a case where the cross-sectional area of the most slender section in the middle sections is very slender such as 19.4 $mm^2$ or less and there is concern that stress corrosion cracking will be further generated, the generation of stress corrosion cracking can be remarkably effectively suppressed according to the operation effect that is present due to the configuration 1 or the like.

Configuration 8

A method of manufacturing a spark plug comprising: a cylindrical insulating body that extends in an axis direction; and a cylindrical metal shell that is fixed on an outer periphery of the insulating body, wherein the metal shell includes a middle section that has a curved shape outer periphery that bulges to an outside in a diametrical direction, the method comprising: when the insulating body and the metal shell are fixed to each other, applying a biasing force with respect to a rear end side of the metal shell along the axis direction in a state where the insulating body passes through the metal shell; heating at least the middle section by electrical conduction; contracting, crushing and deforming the middle section; bending a rear end opening of the metal shell into an inside in the diametrical direction; forming a clamping section; and fixing the insulating body and the metal shell to each other; in the biasing force, wherein assuming that Q(N) is the biasing force when a temperature of the portion that is the most bulged to the outside in diametrical direction of the middle section reaches 600° C., and P(N) is the biasing force when a current value that is 50% of the current value that is applied to the middle section when the portion reaches 600° C., in a prior step in which the temperature of the portion reaches 600° C., $P<Q$ is satisfied.

Also, in a case where an alternative current is applied and the middle section is heated by electrical conduction, "when the current value that is 50% of the current value that is applied to the middle section when the portion reaches 600° C." can be substituted with "when the current value that is 50% of the maximum amplitude of the current value that is initially applied to the middle section when the portion reaches 600° C.".

In a case where the biasing force that is applied to the metal shell is relatively large before the deformation of the middle section is started, the middle section becomes a shape (for example, a shape that is bent even slightly to the outside in the diametrical direction) that is easily bulged toward the outside in the diametrical direction after the deformation of the middle section is started. Accordingly, when the middle section is heated to a temperature at which the middle section is deformable, there is a concern that the middle section will bulge toward the outside only in the diametrical direction.

With respect to this, according to the above-described configuration 8, the biasing force that is applied to the metal shell is controlled so that $P<Q$ is satisfied, wherein Q is the biasing force when the temperature of the portion that is the most bulged toward the outside in the diametrical direction of the middle section reaches 600° C. (in other words, the buckling deformation of the middle section is substantially finished), and P is the biasing force when the current value that is 50% of the current value that is applied to the middle section when the portion reaches 600° C. (in other words, the electrical conduction is started), in the prior step in which the temperature of the portion reaches 600° C. In other words, the clamping process is performed so as to increase the biasing force during from the starting of electrical conduction to the finishing of buckling deformation of the middle section. Accordingly, since the biasing force P that is applied before the buckling deformation is started is relatively small, the middle section is further reliably prevented from being a shape that is easily bulged toward the outside in the diametrical direction before the deformation of the middle section is started. Accordingly, the middle section is not only bulged toward the outside in the diametrical direction but also can be bulged into the inside in diametrical direction and the formation of the recess section can be controlled in the inner periphery portion of the middle section. As a result, the generation of stress corrosion cracking is further reliably prevented in the middle section and superior airtightness and durability can be realized in the manufacturing of the spark plug.

Configuration 9

The method of manufacturing the spark plug according to the configuration 9, wherein $P \leqq 0.8Q$ is satisfied.

According to the above-described configuration 9, since the biasing force that is applied to the metal shell before the deformation is started is further decreased, the middle section can further reliably bulge toward both the inside and the outside in the diametrical direction. As a result, superior airtightness and durability can be further realized.

Configuration 10

The method of manufacturing a spark plug according to the configuration 8 or 9, wherein the temperature of the middle section is 350° C. to 1100° C. when the deformation of the middle section is started.

Also, "when the deformation of the middle section is started" means "when the middle section starts to bulge in diametrical direction after the electrical conduction is started".

According to the above-described configuration 10, the deformation of the middle section is started at the step in which the middle section is sufficiently heated such as to 350° C. or more. Accordingly, the middle section can be further bulged toward the inside in the diametrical direction and the generation of stress corrosion cracking can be further reliably prevented.

A relatively large current is required to flow to the metal shell such that the temperature of the middle section reaches 1100° C. or more. However, when the current is increased, there is a concern that discharge between the metal shell and the mold for the electrical conduction and pressing is generated, and disruption in the clamping process will be generated. Accordingly, the temperature of the middle section is preferably made to be to 1100° C. or less when the deformation of the middle section is started.

Configuration 11

The method of manufacturing the spark plug according to any one of the configuration 8 to 10, wherein a cylindrical mold that has a curved surface corresponding to the clamping section is moved along the axis so that the biasing force is applied with respect to the rear end section of the metal shell, and assuming that a portion that is contacted to the metal shell in the mold is projected to a plane that is orthogonal to the axis and a projected area S ($mm^2$), $P/S \geqq 5$ ($N/mm^2$) is satisfied.

According to the above-described configuration 11, regarding a projection area S that indirectly illustrates an area that is contacted to the metal shell in the mold and the biasing force P that is applied to the metal shell from the mold, the relation of both is set so as to satisfy $P/S \geqq 5$. Accordingly, since the mold and the metal shell are contacted with a relatively large pressure, discharge between the mold and the metal shell can be prevented and the electrical conduction to the metal shell from the mold is further reliably performed. As a result, the middle section can be further reliably deformed to an expected shape that bulges toward both the inside and the outside in the diametrical direction.

Configuration 12

The method of manufacturing the spark plug according to any one of the configuration 8 to 11, wherein a maximum temperature of the middle section is 600° C. to 1300° C. when heating is performed by the electrical conduction.

According to the above-described configuration 12, since the middle section is heated to a temperature in which the middle section is easily deformed, the middle section can be further reliably deformed. Also, the middle section is heated to 600° C. or more so that residual stress by the heat shrinkage at the middle section can be sufficiently generated and the airtightness as the spark plug can be sufficiently secured. Meanwhile, the heating temperature of the middle section is 1300° C. or less so that the middle section can be prevented from being softened and damage (cracking) of the middle section or instability of the shape is further reliably prevented.

Configuration 13

The method of manufacturing the spark plug according to any one of the configuration 8 to 12, wherein a deformation amount of the middle section along the axis is 0.2 mm to 1.0 mm.

According to the above-described configuration 13, since the deformation amount along the axis of the middle section is 0.2 mm or more, the middle section can be sufficiently bulged toward the inside in the diametrical direction and the formation of the recess section in the inner periphery portion of the middle section can be effectively suppressed.

Meanwhile, since the deformation amount along the axis of the middle section is 1.0 mm or less such that the middle section is excessively bulged, the excessive stress residing at the middle section can be further reliably prevented. As a result, it can be assumed that the formation of the recess section can be suppressed, so that the generation of stress corrosion cracking can be further reliably suppressed.

Configuration 14

The method of manufacturing the spark plug according to any one of the configuration 8 to 13, wherein the biasing force that is applied to the rear end section of the metal shell is controlled based on the deformation amount of the middle section along the axis.

According to the above-described configuration 14, since the biasing force that is applied to the rear end section of the metal shell is controlled based on the deformation amount of the middle section, the middle section can be further reliably deformed to the desired shape. As a result, superior airtightness and durability can be further reliably realized in the manufactured spark plug.

Configuration 15

The method of manufacturing the spark plug according to any one of the configuration 8 to 13, wherein a movement amount of jig that biases the rear end section of the metal shell along the axis is controlled based on the deformation amount of the middle section along the axis.

According to the above-described configuration 15, the middle section can be further reliably deformed to the desired shape, and superior airtightness and durability can be further reliably enhanced in the manufacturing of the spark plug.

DESCRIPTION OF EMBODIMENTS

Figure 1:
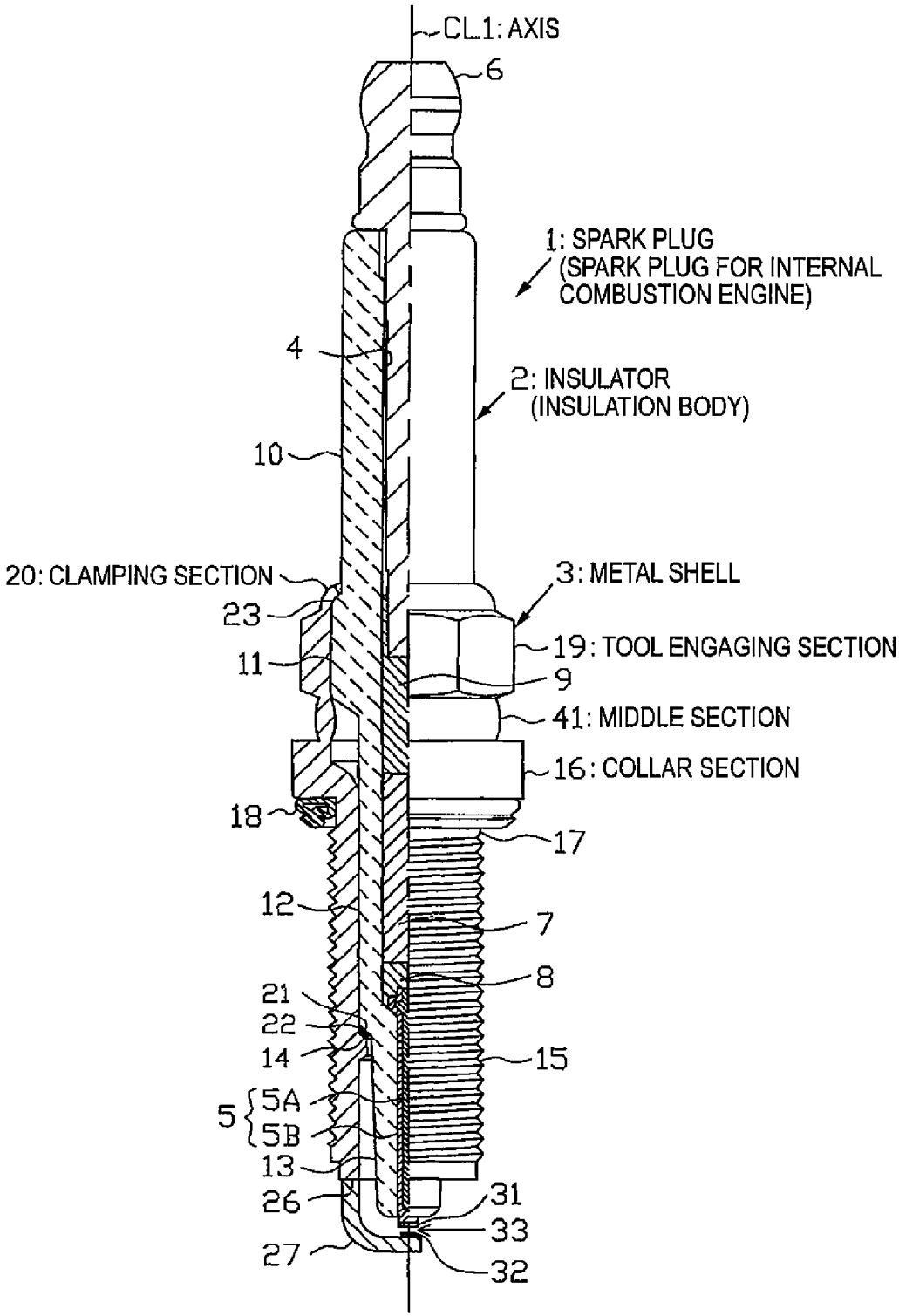
FIG. 1 is a partially cutaway front view illustrating a configuration of a spark plug.

Hereinafter, an embodiment will be described with reference to drawings. FIG. 1 is a partially cutaway front view illustrating a configuration of spark plug 1 (hereinafter, referred to as "spark plug") for an internal combustion engine. In FIG. 1, description will be given as an axis CL1 direction of the spark plug 1 is the up and down direction, and the lower side is the leading end side of the spark plug 1 and the upper side is the rear end side.

The spark plug 1 is configured of an insulator 2 as an insulation body that is a cylinder shape and a cylinder shape metal shell 3 that holds the insulator 2.

The insulator 2 is formed by burning alumina or the like as known in the art and includes in the exterior section, a rear end side cylinder section 10 that is formed at the rear end side, a large diameter section 11 that is formed and projected further to the outside in the diametrical direction in a leading end side than the rear end side cylinder section 10, a middle body section 12 that is formed in a smaller diameter at the leading end side than the large diameter section 11 and a leg section 13 that is formed in a smaller diameter at the leading end side than the middle body section 12. Further, the large diameter section 11, the middle body section 12 and almost of the leg section 13 of the insulator 2 are accommodated within the metal shell 3. A taper shape step section 14 is formed at the connection section between the leg section 13 and the middle body section 12 wherein the taper shape is reduced in its diameter toward the leading end side in the axis CL1 direction and the insulator 2 is engaged to the metal shell 3 at the step section 14.

Furthermore, an axial hole 4 passes through and is formed in the insulator 2 along the axis CL1 and a center electrode 5 is inserted and fixed at the leading end side of the axial hole 4. The center electrode 5 is configured of an inner layer 5A that is made of copper or a copper alloy, and an outer layer 5B that is made of a Ni alloy in which nickel (Ni) is the main component. Also, the center electrode 5 has an overall rod shape (a round column shape) and the leading end section thereof is projected from the leading end of the insulator 2. Furthermore, a round column shape noble metal tip 31 that is formed by a noble metal alloy (for example, an iridium alloy) is welded to the leading end section of the center electrode 5.

Also, a terminal electrode 6 is inserted and fixed at the rear end side of the axial hole 4 in a state that the terminal electrode 6 is projected from the rear end of the insulator 2.

Furthermore, a round column shape resistor 7 is arranged between the center electrode 5 of the axial hole 4 and the terminal electrode 6. Both end sections of the resistor 7 are electrically connected to the center electrode 5 and the terminal electrode 6 through conductive glass seal layers 8 and 9 respectively.

In addition, the metal shell 3 is formed in a cylinder shape from a metal such as a low-carbon steel and a screw section (a male screw section) 15 is formed at the outer peripheral surface thereof so as to attach the spark plug 1 to an engine head. Also, a collar section 16 that bulges to the outside in the diametrical direction at the outer peripheral surface of the rear end side of the screw section 15 and a ring shape gasket 18 is inserted at a screw head 17 of the rear end of the screw section 15. Furthermore, a tool engaging section 19 that has a hexagonal cross-section so as to engage with a tool such as wrench when the spark plug 1 is attached to the engine head is mounted at the rear end side of the metal shell 3 and a clamping section 20 that holds the insulator 2 is mounted at the rear end section. Also, a middle section 41 that has a curve shaped outer periphery that bulges to the outside of the diametrical direction is formed between the collar section 16 and the tool engaging section 19 of the metal shell 3 (the middle section 41 will be described below). In the embodiment, the spark plug 1 has a relatively small diameter (for example, the screw diameter of the screw section 15 is the same or less than M12) and then the metal shell 3 also has a small diameter.

Furthermore, a step section 21 that is reduced in its diameter toward the leading end side in an axis CL1 is formed at the inner peripheral surface of the metal shell 3 so as to engage the insulator 2. Thus, the insulator 2 is inserted to the leading end side from the rear end side of the metal shell 3. In a state where the insulator 2 is inserted into the leading end side from the rear end side of the metal shell 3 and the step section 14 itself is engaged to the step section 21 of the metal shell 3, the middle section 41 is induced to buckle and the clamping section 20 is formed by a so-called heat clamping so that the insulator 2 is held at the metal shell 3. Also, the clamping section 20 has a shape that imitates a shoulder section 23 that is step shaped and positioned at the rear end side of the large diameter section 11 and then the clamping section 20 is engaged to the shoulder section 23. A circular shape plate packing 22 is interposed between both step sections 14 and 21. Accordingly, airtightness of the combustion chamber is maintained and a fuel-air mixture or the like that enters to a clearance between the leg section 13 of the insulator 2 that is projected within the combustion chamber and the inner peripheral surface of the metal shell 3 is not leaked to the outside.

A ground electrode 27 that is formed of Ni alloy and the middle section thereof is bent is welded at the leading end surface 26 of the metal shell 3. A round column shape noble metal tip 32 that is formed by the noble metal alloy (for example, platinum alloy) is welded at the leading end section of the ground electrode 27, and the leading end surface of the noble metal tip 32 is opposite to the leading end surface of the noble metal tip 31. Thus, a spark-discharge clearance 33 is formed between the noble metal tips 31 and 32, and the spark discharge is performed in a direction substantially along the axis CL1.

Figure 2:
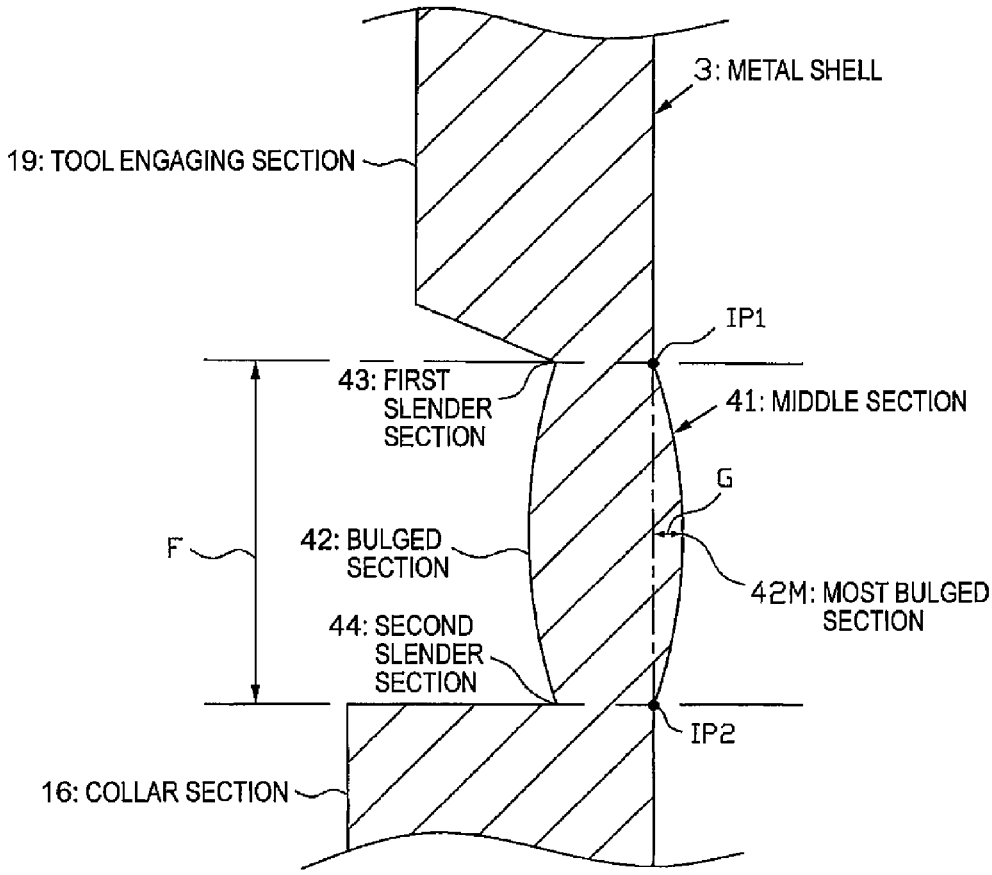
FIG. 2 is a partially enlarged cross-sectional view illustrating a middle section or the like of a metal shell.

Next, the middle section 41 will be described. As shown in FIG. 2, the middle section 41 has the bulged section 42, the first slender section 43 and the second slender section 44.

The bulged section 42 is formed of substantially the center portion of the middle section 41 in the axis CL1 direction and has a shape that bulges to both inside and outside of the diametrical direction. Also, the first slender section 43 is positioned at the rear end side of the bulged section 42 in the axis CL1 direction and formed in most slender of portions that are positioned further to the rear end side than the bulged section 42 of the middle section 41. Furthermore, the second slender section 44 is positioned at the leading end side of the bulged section 42 in the axis CL1 direction and formed in most slender of portions that are positioned further to the leading end side than the bulged section 42 of the middle section 41.

Furthermore, the middle section 41 is formed to satisfy $0.00<G/F\leqq 0.18$ when F (mm) is a distance between the first slender section 43 and the second slender section 44 along the axis CL1 direction and G (mm) is a bulged amount to the inside in the diametrical direction of a most bulged section 42M that is the most bulged to the inside in the diametrical direction of the bulged sections 42 with respect to an imaginary line VL that connects a portion IP1 and the portion IP2 wherein the portion IP1 is positioned furthest to the inside in the diametrical direction of the first slender sections 43 and the portion IP2 is positioned furthest to the inside in the diametrical direction of the second slender sections 44.

Additionally, a cross-sectional area becomes $H\leqq 35$ when H ($mm^2$) is a cross-sectional area that is the smaller in size of the areas of the first slender section 43 and the second slender section 44 in a cross-section that is orthogonal to the axis CL1. In other words, according to the compact of the metal shell 3, the middle section 41 is formed to be relatively slender.

The middle section 41 is heated by electrical conduction during a clamping process (clamped by heating) as described below, and is cooled naturally after being heated by electrical conduction. Thus, the middle section 41 can be in a state such that quenching and annealing are performed due to the cooling velocity of the middle section 41. In the embodiment, when the middle section 41 is cooled, a temperature regulation is not specifically performed and then a relatively large hardness difference at each portion of the middle section 41 can occur. In other words, in the embodiment, the middle section 41 may be obtained so as to satisfy any one of the formulae $2\leqq|E1-E3|$ and $20\leqq|E2-E3|$, when E1(Hv) is a Vickers hardness of the first slender section 43, E2 (Hv) is a Vickers hardness of the second slender section 44 and E3 (Hv) is a Vickers hardness of the most bulged section 42M.

Next, a manufacturing method of the spark plug 1 that is configured as in the above description will be described.

The insulator 2 is obtained by a molding process. For example, a raw material powder that includes binder and alumina as a main component is used, basis agglomerated material for the molding is manufactured and a rubber press molding is performed using the mold so that a cylinder shape molding body is obtained. Thus, a grinding process is performed on the outer appearance thereof with respect to the obtained molding body, and then a burning process is performed so that the insulator 2 is obtained.

Also, the center electrode 5 is manufactured separately from the insulator 2. In other words, a Ni alloy in which copper alloy is arranged in the center so as to enhance heat release property is forging processed and the center electrode 5 is manufactured. Next, the noble metal tip 31 is welded with respect to the leading end surface of the center electrode 5 by a laser welding or the like.

Thus, the insulator 2 and the center electrode 5 that are obtained as described above, the resistor 7 and the terminal electrode 6 are sealed and fixed by the glass seal layers 8 and 9 to each other, and the center electrode 5 is attached to the insulator 2. As the glass seal layers 8 and 9, generally borosilicate glass and metal powder are mixed and manufactured. After the glass seal layers 8 and 9 are inserted into the axial hole 4 of the insulator 2 so that the glass seal layers 8 and 9 pinch the resistor 7, the glass seal layers 8 and 9 are fired and fixed within a burning furnace in a state where the terminal electrode 6 is biased from the rear side. At this time, a glaze layer may be fired simultaneously at the surface of the rear end side cylinder section 10 of the insulator 2 or the glaze layer may be formed beforehand.

Next, the metal shell 3 is machined beforehand. In other words, a through-hole is formed by a cold forging process to a round column shape metal material (for example, steel based material or stainless material such as S17C or S25C), and then a rough shape is formed. After that, a cutting process is performed, the outer shape is formed, the screw section 15 is formed by a rolling process in a predetermined portion and then the middle body of the metal shell is obtained. Furthermore, zinc plating or nickel plating is performed at the middle body of the metal shell. Furthermore, a chromate process may be performed on the surface so as to enhance corrosion resistance.

After that, a straight rod shape ground electrode 27 is resistance welded at the leading end surface of the middle body of the metal shell. When the welding is performed, a so-called "sagging" is generated, so that after the "sagging" is removed, the screw section 15 is formed by the rolling process at a predetermined portion of the middle body of the metal shell. Accordingly, the metal shell 3 that is welded to the ground electrode 27 is obtained. Also, the zinc plating or the nickel plating is performed at the metal shell 3 that is welded to the ground electrode 27. Furthermore, a chromate process may be performed on the surface so as to enhance corrosion resistance. After the plating is performed, the plating that covers a portion that corresponds to at least a bending portion of the ground electrode 27 is removed.

Figure 3:
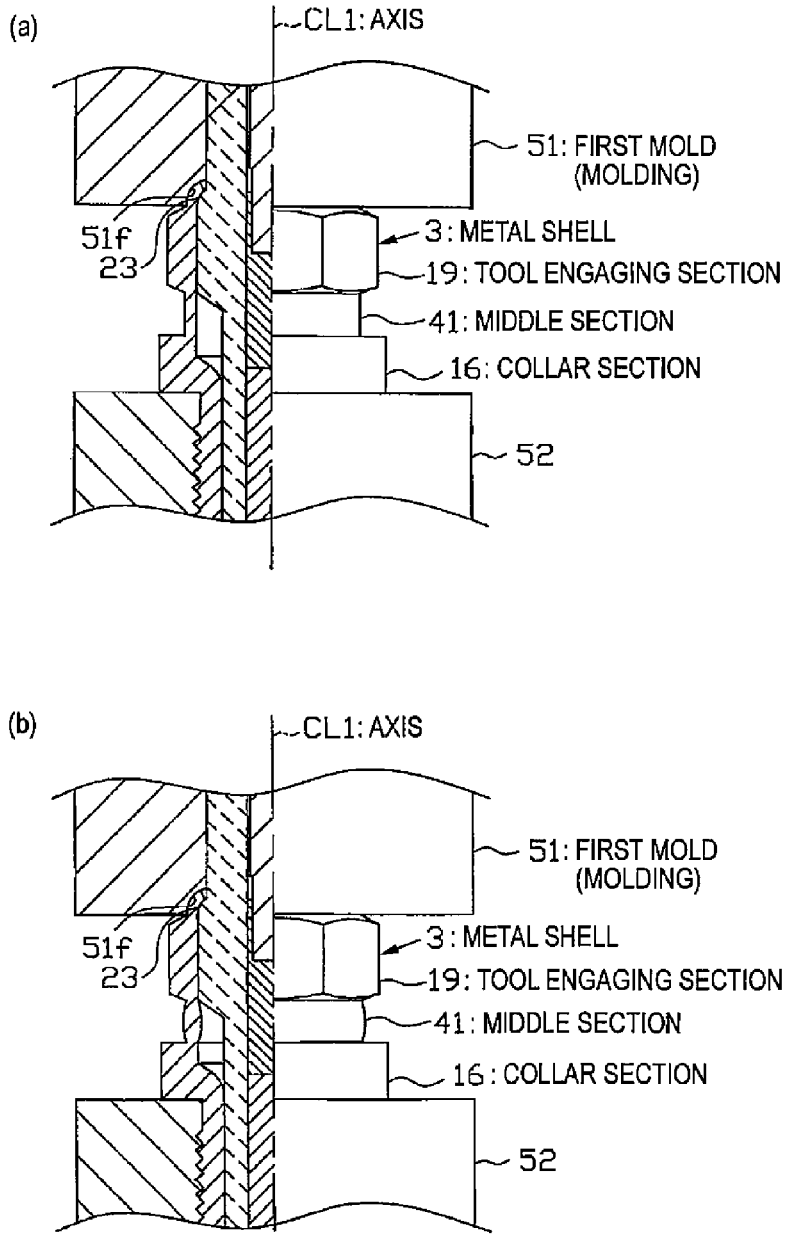
FIG. 3 is a figure showing, in (a) and (b) of FIG. 3, enlarged front views in partial cutaway illustrating clamping process.

After that, as described above, the insulator 2 that includes the center electrode 5 and the terminal electrode 6, and the metal shell 3 that includes the ground electrode 27 that are respectively formed are fixed. When the fixing is performed, a so-called heat tightening is performed. In other words, as shown in (a) of FIG. 3, the leading end side of the metal shell 3 is inserted into a second mold 52 so that the metal shell 3 is held by the second mold 52. Also, before the clamping process, the middle section 41 is a cylinder shape without bulging to both the outside and inside in the diametrical direction.

Next, a first mold 51 is mounted from the upper side of the metal shell 3. The first mold 51 has a cylinder shape and includes a clamping-form section 51*f* that has a curved surface that corresponds to the shape of the clamping section 20. Also, when a portion that is contacted to the metal shell 3 is projected to a plane that is orthogonal to the axis CL1 along the axis CL1 direction at the time of clamping machining, the first mold 51 is formed so that the area of the projected portion has a predetermined area S (for example, 90 $mm^2$).

Next, the metal shell 3 (the middle section 41) is heated by electrical conduction by a predetermined power-supply apparatus (not shown) through the first mold 51 and the metal shell 3 is pinched by both the first and the second molds 51 and 52, and a predetermined biasing force is added along the axis CL1 direction with respect to the metal shell 3. Accordingly, the rear end side opening of the metal shell 3 is clamped to the inside of the diametrical direction and the clamping section 20 is formed.

Also, when the middle section 41 is heated to a predetermined temperature (for example, from more than 350° C. to less than 1100° C.) by the electrical conduction and deformation resistance of the middle section 41 becomes small relatively, buckling deformation of the middle section 41 is started by the biasing force that is applied from both molds 51 and 52. At this time, both molds 51 and 52 are controlled so as to increase the biasing force that is applied to the metal shell 3 until the buckling deformation of the middle section 41 is finished.

In other words, the biasing force that is applied to the metal shell 3 is controlled so as to satisfy P<Q (for example, P≦0.8Q), wherein Q (N) is the biasing force when the temperature of the portion that is the most bulged to the outside in the diametrical direction of the middle section 41 reaches 600° C. (in other words, when the buckling deformation of the middle section 41 is mostly finished), and P (N) is the biasing force when the current that is 50% of the current of when the portion reaches 600° C. in the prior step in which the temperature of the portion that is the most bulged to the outside in the diametrical direction of the middle section 41 reaches 600° C. (in other words, when electrical conduction is started). As a result, as shown in (b) of FIG. 3, the middle section 41 after deformation is deformed by buckling so that the middle section 41 bulges not only to the outside in the diametrical direction but also both the outside and the inside in the diametrical direction.

In the embodiment, the biasing force that is applied to the metal shell 3 from both molds 51 and 52 is controlled based on the deformation amount of the middle section 41 along the axis CL1 and the deformation amount becomes 0.2 mm or more to 1.0 mm or less along the axis CL1 of the middle section 41. Additionally, the middle section 41 is heated by electrical conduction so that the highest temperature of itself reaches 600° C. or more to 1300° C. or less.

After the heating by electrical conduction to the middle section 41 is finished, the middle section 41 that is in a thermal expansion state is naturally cooled and the middle section 41 contracts in the axis CL1 direction, and the clamping section 20 that is engaged to the shoulder section 23 biases the shoulder section 23 to the leading end side. Thus, the step section 14 that is formed at the outer peripheral surface of the insulator 2 and the step section 21 that is formed at the inner peripheral surface of the metal shell 3 reaches a strongly engaged state, and the insulator 2 and the metal shell 3 are strongly fixed.

Next, after removing the plating of the leading end section of the ground electrode 27, the noble metal tip 32 is welded to the leading end section of the ground electrode 27 by resistance welding or the like. Last, the ground electrode 27 is bent toward the center electrode 5 and the size of the spark-discharge clearance 33 between the noble metal tips 31 and 32 is controlled so that the above-described spark plug 1 is obtained.

As described above, according to the embodiment, the biasing force that is applied to the metal shell 3 is controlled so as to satisfy P<Q wherein Q is the biasing force when the temperature of the portion that is the most bulged to the outside in the diametrical direction of the middle section 41 reaches 600° C. (in other words, when the buckling deformation of the middle section 41 is mostly finished), and P is the biasing force when the current that is 50% of the current value of when the portion reaches 600° C. in the prior step in which the temperature of the portion that is the most bulged to the outside in the diametrical direction of the middle section 41 reaches 600° C. (in other words, when electrical conduction is started). In other words, the clamping process is performed so that the biasing force is increased in the period from when the electrical conduction is started to when the buckling deformation of the middle section 41 is finished. Accordingly, since the biasing force that is applied before the middle section 41 is started to be buckling deformation is relatively small, the middle section 41 is reliably prevented from becoming a shape that is easily bulged to the outside in the diametrical direction before the middle section 41 is started to be deformed. Thus, the middle section 41 can be bulged not only to the outside in the diametrical direction but also to the inside in the diametrical direction and formation of a recess section in the inner peripheral section of the middle section 41 can be suppressed. As a result, generation of corrosion cracking due to the stress can be reliably prevented in the middle section 41 and excellent airtightness or durability can be realized in the manufactured spark plug 1.

Furthermore, at a step in which the middle section 41 is sufficiently heated to 350° C. or more, the deformation of the middle section 41 is started. Accordingly, the middle section 41 can be bulged more reliably to the inside in the diametrical direction and the generation of corrosion cracking due to the stress can be further reliably prevented. Meanwhile, since the temperature of the middle section becomes lower than 1100° C. when the deformation is started, generation of discharge between the metal shell 3 and the first molding 51 can be prevented and the clamping process can be performed without any obstacle.

Additionally, regarding the projected area S ($mm^2$) that indirectly indicates the area of the portion that is contacted to the metal shell 3 of the first mold 51 and the biasing force P (N) that is applied to the metal shell from the molding, the relationship between both is set to satisfy $P/S \geqq 5(N/mm^2)$. Accordingly, since the first mold 51 and the metal shell 3 are contacted with a relatively large pressure, the discharge between the first mold 51 and the metal shell 3 can be prevented and the electrical conduction from the first mold 51 to the metal shell 3 can be more reliably performed. As a result, the middle section 41 is deformed so that the middle section 41 becomes a predetermined shape that bulges to both of the outside and the inside in the diametrical direction and can be further reliably deformed by the clamping process.

Additionally, since the highest temperature of the middle section 41 reaches 600° C. or more to 1300° C. or less when the heating by the electrical conduction, the middle section 41 can be further reliably and easily deformed.

Also, since the deformation amount of the middle section 41 along the axis CL1 becomes 0.2 mm or more, the middle section 41 can be sufficiently bulged to the inside in the diametrical direction and can effectively suppress the formation of the recess section in the inner peripheral section of the middle section 41. Meanwhile, since the deformation amount of the middle section 41 along the axis CL1 becomes 1.0 mm or less, the middle section 41 is prevented from bulging excessively, residual excessive stress at the middle section 41 can be prevented, and then the generation of corrosion cracking due to the stress can be further reliably prevented.

Additionally, since the biasing force that is applied to the rear end section of the metal shell 3 is controlled based on the deformation amount of the middle section 41, the middle section 41 can be further reliably deformed to the desired shape.

Furthermore, in a case where a relatively large difference in hardness such as 20 Hv or more is generated between the most bulged section 42M and the first and the second slender sections 43 and 44 due to the cooling after heating by electrical conduction, there is concern that corrosion cracking will be further generated but when the middle section 41 has the shape (in other words, $0.00 < G/F \leqq 0.18$) that is bulged to both of the inside and the outside in the diametrical direction as described above, so that the generation of corrosion cracking due to the stress can be effectively prevented even in the condition that the corrosion cracking due to the stress is easily generated at the surfaces that have the hardness difference.

As in the embodiment, according to the small diameter of the spark plug 1, in a case where the cross-sectional area H that is in relatively smaller side in the cross-sectional area of the first slender section 43 and the cross-sectional area of the second slender section 44 becomes 35 $mm^2$ or less that is relatively small, there is concern that corrosion cracking will be further generated, however the middle section 41 has the shape as described above, so that the generation of corrosion cracking due to the stress can be further effectively prevented even in the case where the middle section 41 is relatively slender.

Next, an evaluation test of corrosion-resistant cracking is performed to certify the operation effect that is present by the embodiment. A summary of the evaluation test of corrosion-resistant cracking is described below. In other words, samples of the spark plugs are prepared in groups of in twenties respectively, wherein the length of the middle section along the axis is changed before deformation and the condition of the application of the load, electrical conduction or the like are changed and the clamping process is performed so that the distance F between both slender sections along the axis is constant and the bulged amounts G of the most bulged sections with respect to the imaginary line that connects the most inner peripheral sections of both slender sections are varied (in other words, the values of G/F are varied). Thus, the corrosion liquid that is composed of calcium nitrate tetrahydrate of a density of 60 mass % and ammonium nitrate of a density of 3 mass %, and each of the samples is input into the corrosion liquid. Next, after elapse of 24 hours from the input, the presence or not of the cracking at the middle section is verified. In a case where the cracking is not generated in all twenty samples, the generation of stress corrosion cracking can be effectively prevented so that the evaluation of "○" is decided on and in a case where the cracking is generated at any one of twenty samples, there is concern about generation of stress cracking so that an evaluation of "X" is decided on. The test result of the evaluation test of the corrosion-resistant cracking is illustrated in Table 1. Also, in a column of G/F in Table 1, a description of "not bulged into the inside" is means that the middle section does not bulge toward the inside in the diametrical direction but bulge toward the outside in the diametrical direction. Additionally, in the test, the thickness of both slander sections is 0.8 mm; the cross-sectional area of both slander sections in the cross-section that is orthogonal to the axis is 35 $mm^2$ and the distance F along the axis of between both slender sections is 1.8 mm.

TABLE 1

| | G/F | | | | | | | | | | |
|---|---|---|---|---|---|---|---|---|---|---|---|
| | No bulge into the inside | 0.00 | 0.01 | 0.02 | 0.05 | 0.10 | 0.13 | 0.15 | 0.18 | 0.20 | 0.22 |
| Determination | X | X | ○ | ○ | ○ | ○ | ○ | ○ | ○ | X | X |

As shown in Table 1, when G/F is larger than 0.00, in other words, the middle section is configured so as to bulge into the inside in the diametrical direction, it is obvious that the generation of cracking in the middle section is effectively suppressed. This is assumed to be because the middle section bulges into the inside in the diametrical direction so that the recess section that is the cause of generation of stress corrosion cracking is not formed at the inner periphery portion of the middle section.

Meanwhile, regarding the sample in which G/F is over 0.18, the generation of the cracking is verified in the middle section. This thought to be because the bulged amount into the inside in the diametrical direction of the middle section is excessively large during clamped by heating.

Next, under conditions where the shape of the sample, the corrosion liquid or the like are the same condition as in the above description, the sample is input into the corrosion liquid and the time is changed to 48 hours from 24 hours and the evaluation test of the corrosion cracking is performed. The result of the test is illustrated Table 2.

TABLE 2

| | G/F | | | | | | | | | | |
|---|---|---|---|---|---|---|---|---|---|---|---|
| | No bulge into the inside | 0.00 | 0.01 | 0.02 | 0.05 | 0.10 | 0.13 | 0.15 | 0.18 | 0.20 | 0.22 |
| Determination | X | X | ○ | ○ | ○ | ○ | ○ | ○ | X | X | X |

As shown in Table 2, in a case where G/F is larger than 0.00, the input time into the corrosion liquid becomes 48 hours and the generation of stress corrosion cracking is effectively suppressed even in an environment in which cracking is easily generated in the middle section. Meanwhile, regarding the sample in which the G/F is 0.18, in other words, regarding the sample in which the bulged amount into the inside in the diametrical direction of the middle section is relatively large, the generation of cracking is verified.

As described above, considering the overall results of the tests, it is preferable that the middle section bulges not only to the outside in the diametrical direction but also into the inside in the diametrical direction, in other words, the middle section is formed so as to satisfy $G/F>0.00$ to prevent the generation of the stress corrosion cracking. Meanwhile, when the middle section is excessively bulged to the outside in the diametrical direction, the stress excessively resides in the middle section and there is concern that stress corrosion cracking may be incurred. Accordingly, it is preferable that the middle section is formed so as to satisfy $0.00<G/F\leqq 0.18$ and more preferable that the middle section is formed so as to satisfy $0.00<G/F\leqq 0.15$ to reliably prevent the generation of the stress corrosion cracking.

Figure 4:
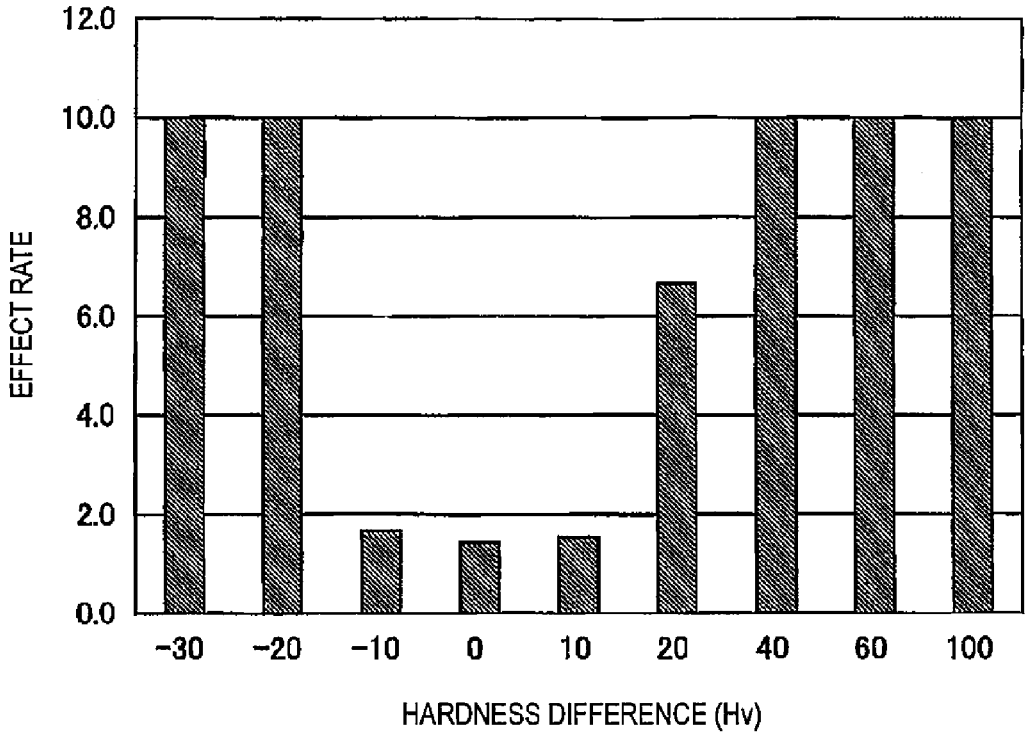
FIG. 4 is a graph illustrating relation between a hardness difference and an effect rate.

Next, after G/F=0.00 or G/F=0.10, the condition is changed when the middle section is cooled, and then samples of the spark plug are prepared in groups of twenty in which the hardness difference of the hardness E1 and E2 (Hv) of the first and the second slender section with respect to the hardness E3 (Hv) of the most bulged section undergo various changes and the above-described evaluation test of the corrosion-resistant cracking is performed regarding each of the samples. Also, the input time of the samples into the corrosion liquid is 24 hours. In Table 3, the number (number of good articles that verifies the generation of the cracking in the twenty is illustrated, with respect to the samples in which G/F is 0.00 and the samples in which G/F is 0.10, and a value (an effect rate) is illustrated that is obtained from subtracting the number of good articles of the samples in which G/F is 0.10 from the number of good articles of the samples in which G/F is 0.00. Also, FIG. 4 is a graph illustrating the relation between the hardness difference and the effect rate. Also, "the hardness difference" means the value that is larger between the absolute values of "E3−E1" and "E3−E2". Also, "the effect rate" means that the effect becomes larger as the value increases when G/F is 0.00 to when G/F is 0.10 (in other words, when the bulge occurs into the inside in the diametrical direction).

TABLE 3

| Hardness Difference | | −30 | −20 | −10 | 0 | 10 | 20 | 40 | 60 | 100 |
|---|---|---|---|---|---|---|---|---|---|---|
| The number of good articles | G/F = 0.00 | 2 | 2 | 12 | 14 | 13 | 3 | 2 | 2 | 2 |
| | G/F = 0.10 | 20 | 20 | 20 | 20 | 20 | 20 | 20 | 20 | 20 |
| Effect Rate | | 10.0 | 10.0 | 1.7 | 1.4 | 1.5 | 6.7 | 10.0 | 10.0 | 10.0 |

As shown in Table 3, the sample in which G/F is 0.10 verifies the generation of cracking in all samples regardless of the size of the hardness difference. Meanwhile, in the samples in which G/F is 0.00, the generation of the cracking is verified, and specifically, it is clear that the number of good articles is extremely decreased when the hardness difference is 20 or more. It is appears that the stress is concentrated on the place in which the hardness difference is generated and then stress corrosion cracking is easily generated. Accordingly, as known from the relation between the hardness difference and the effect rate shown in FIG. 4, G/F is larger than 0.00 so that the operation effect is appears more remarkably in a case where the absolute value of the hardness difference is relatively large such as 20 or more. In other words, that G/F is larger than 0.00, in other words, the middle section is bulged into the inside in the diametrical direction is significant in a case where the absolute value of the hardness difference in the middle section is 20 or more.

Figure 5:
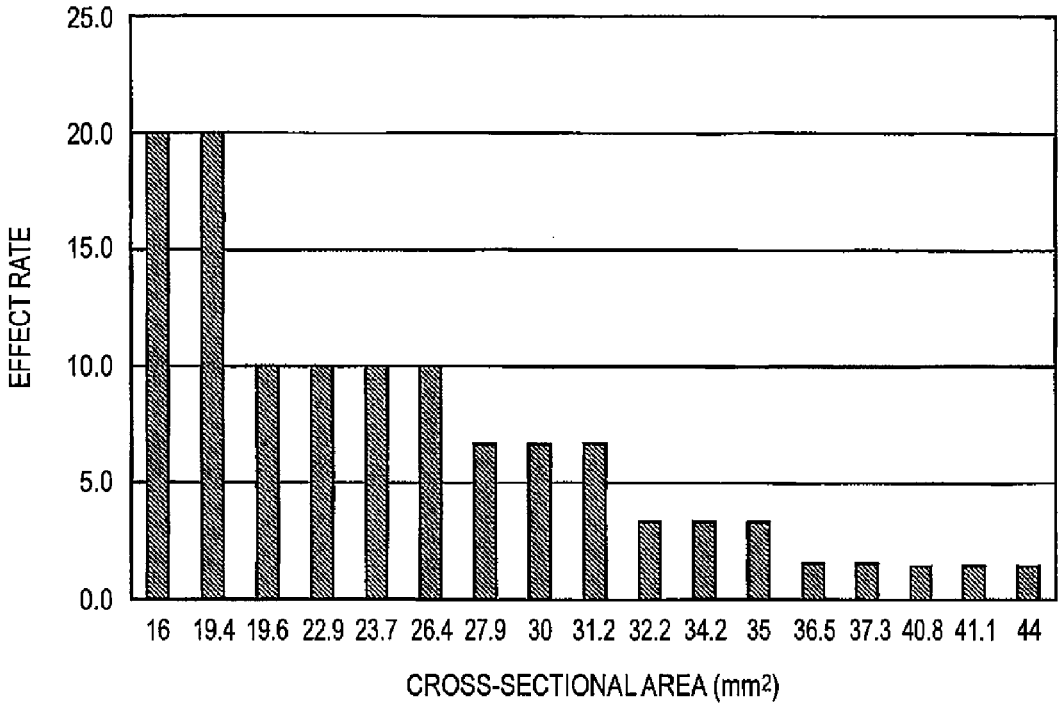
FIG. 5 is a graph illustrating relation between a cross-sectional area and the effect rate.
Figure 6:
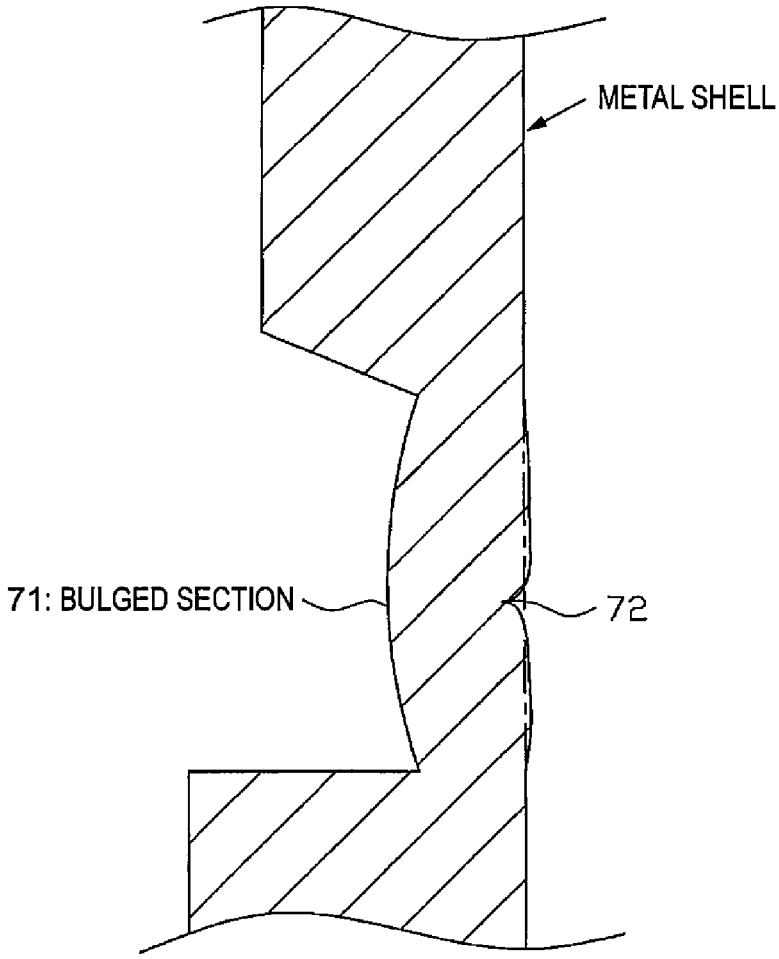
FIG. 6 is a partially enlarged cross-sectional view illustrating the metal shell of an improper bulged section.

Next, after G/F=0.00 or G/F=0.10, the thickness of the metal shell is changed and then the samples of the spark plug in which the cross-sectional area H ($mm^2$) of the first and the second slender sections along the direction orthogonal to the axis is varied and the evaluation test of the above-described corrosion-resistant cracking is performed with respect to each of the samples. Thus, the number of good articles is measured respectively with respect to the samples in which G/F is 0.00 and G/F is 0.10, and the above-described effect rate is computed. Also, the input time of the sample to the corrosion liquid is 48 hours. In Table 4 and Table 5, the results of the test are illustrated and FIG. 5 is a graph illustrating the relation between a cross-sectional area H and the effect rate. Also, "the cross-sectional area H" is the value of the smaller side in the cross-sectional area of the first slender section and the cross-sectional area of the second slender section.

TABLE 4

| Cross-sectional Area H ($mm^2$) | | 16 | 19.4 | 19.6 | 22.9 | 23.7 | 26.4 | 27.9 | 30 |
|---|---|---|---|---|---|---|---|---|---|
| The number of good articles | G/F = 0.00 | 1 | 1 | 2 | 2 | 2 | 2 | 3 | 3 |
| | G/F = 0.10 | 20 | 20 | 20 | 20 | 20 | 20 | 20 | 20 |
| Effect Rate | | 20.0 | 20.0 | 10.0 | 10.0 | 10.0 | 10.0 | 6.7 | 6.7 |

TABLE 5

| Cross-sectional Area H ($mm^2$) | | 31.2 | 32.2 | 34.2 | 35 | 36.5 | 37.3 | 40.8 | 41.1 | 44 |
|---|---|---|---|---|---|---|---|---|---|---|
| The number of good articles | G/F = 0.00 | 3 | 6 | 6 | 6 | 13 | 13 | 14 | 14 | 14 |
| | G/F = 0.10 | 20 | 20 | 20 | 20 | 20 | 20 | 20 | 20 | 20 |
| Effect Rate | | 6.7 | 3.3 | 3.3 | 3.3 | 1.5 | 1.5 | 1.4 | 1.4 | 1.4 |

As illustrated in Table 4 and Table 5, the sample in which G/F is 0.10 verifies no generation of the cracking in all samples regardless of the size of the cross-sectional area H. Meanwhile, the generation of the cracking is certified in all samples in which G/F is 0.00, and specifically, when the cross-sectional area H is 35 $mm^2$ or less, it is clear that the number of good articles is extremely decreased. This is assumed to be because the cross-sectional area H is relatively small as 35 $mm^2$ or less so that the stress per unit cross-sectional area that is applied with respect to the middle section is increased. Accordingly, as known from the relation between the cross-sectional area H and the effect rate as shown in FIG. 4, in a case where the cross-sectional area H is relatively small such as 35 $mm^2$ or less, when G/F is more than 0.00, the effect is more remarkably present. In other words, that G/F is larger than 0.00, in other words, the middle section bulges into the inside in the diametrical direction is significant specifically, in a case where the cross-sectional area H is 35 $mm^2$ or less according to the tendency of the small diameter of the spark plug.

Further, the cross-sectional area H is small and G/F is 0.00 so that the operation is effectively exerted. In other words, as shown in FIG. 4, G/F is more than 0.00 so that the suppression effect of the cracking is further remarkably exerted when the cross-sectional area H is 31.2 $mm^2$ or less, more remarkably exerted when the cross-sectional area H is 26.4 $mm^2$ or less, and extremely exerted when the cross-sectional area H is 19.4 $mm^2$ or less.

As described above, considering the result of the tests, in a case where the hardness difference is generated to be relatively large such as 20 Hv or more in the middle section and the cross-sectional area H is relatively small such as 35 $mm^2$ or less, the middle section bulges into the inside in the diametrical direction so that the operation effect is remarkably exerted.

Next, after the biasing force Q (N) is constant when the temperature of the portion that is the most bulged to the outside in the diametrical direction of the middle section reaches 600° C. (when the buckling deformation of the middle section is substantially finished), in the prior step in which the temperature of the portion that is the most bulged to the outside in the diametrical direction in the middle section reaches 600° C., when the current that is 50% of the maximum magnitude of the current of when the portion reaches 600° C. (when the electrical conduction is started), the biasing force P(N) is varied, the clamping process is performed and then a plurality of samples of the spark plug is prepared in groups of twenty. Next, the middle sections are inspected respectively with respect to each of the prepared samples and the cross-section shape of the middle sections is specified. Thus, in a case where the middle section bulges both into the inside and to the outside in the diametrical direction in all twenty samples, a preferable shape is capable of forming in an extremely high ratio in view of preventing the stress corrosion cracking, an evaluation of "◎" is decided on, and in a case where the middle section bulges both into the inside and to the outside in the diametrical direction in half or more in twenty samples, a preferable shape is capable of forming in a high ratio in view of preventing the stress corrosion cracking, an evaluation of "○" is decided on. Meanwhile, in a case where the middle section dose not bulge into the inside in the diametrical direction in half or more of the twenty samples, it is difficult to form the middle section in the shape that bulges both into the inside and to the outside in the diametrical direction, an evaluation of "X" is decided on. In Table 6, the biasing forces P, Q and evaluation are illustrated.

TABLE 6

| P(N) | Q(N) | Evaluation |
|---|---|---|
| $1.0 \times 10^3$ | $2.0 \times 10^3$ | ◎ |
| $1.3 \times 10^3$ | $2.0 \times 10^3$ | ◎ |
| $1.6 \times 10^3$ | $2.0 \times 10^3$ | ◎ |
| $1.8 \times 10^3$ | $2.0 \times 10^3$ | ○ |
| $1.9 \times 10^3$ | $2.0 \times 10^3$ | ○ |
| $2.0 \times 10^3$ | $2.0 \times 10^3$ | X |
| $2.3 \times 10^3$ | $2.0 \times 10^3$ | X |

As shown in Table 6, in a case where the spark plug is formed as the biasing force P is the biasing force Q or less, it is clear that the middle section can bulge toward both the inside and the outside in the diametrical direction in a high ratio. Since the biasing force P that is applied prior to starting of the deformation is relatively small, the middle section is reliably prevented from becoming a shape that is easily bulged to the outside in the diametrical direction. Specifically, in a case where the biasing force P is 0.8Q or less, the middle section can bulge toward both the inside and the outside in the diametrical direction in an extremely high ratio and the middle section is further preferable in view of preventing stress corrosion cracking of the spark plug that is manufactured.

As described above, the biasing force is preferably adjusted so as to satisfy $P<Q$ so that the middle section bulges both into the inside and to the outside in the diametrical direction and the biasing force is preferably adjusted so as to satisfy $P \leqq 0.8Q$.

Next, after the projection area S is constant so as to certify the relation between the projection area S and the biasing force P when the portion that is contacted to the metal shell in the first molding is projected on the plane that is orthogonal to the axis along the axial direction, the biasing force P is varied, the clamping process is performed and the samples of the spark plug are prepared in groups of twenty respectively. Thus, in a case where an abnormal discharge is not generated between the first mold and the metal shell, and the clamping process can be performed without any problem with respect to each of the samples, an evaluation of "○" is decided on, and in a case where an abnormal discharge is generated between the first mold and the metal shell, and the clamping process is hindered by the failure of electrical conduction, an evaluation of "Δ" is decided on. In Table 7, the biasing force P and the evaluation are illustrated. Also, the projection area S is 90 $mm^2$ and the biasing force Q is $2.0 \times 10^3$ N.

TABLE 7

| P(N) | 300 | 400 | 450 | 600 | 800 |
|---|---|---|---|---|---|
| Evaluation | Δ | Δ | ○ | ○ | ○ |

As shown in Table 7, when the biasing force P is less than 450 N, in other words, when $P/S<5$ ($N/mm^2$), failure of electrical conduction is generated and then it is clear that the clamping process is disrupted. Meanwhile, when the biasing force P is 450 N or more, in other words, when $P/S \geqq 5$ ($N/mm^2$), failure of electrical conduction is not generated and then the clamping process is performed without any problem. This is assumed to be because the biasing force per unit area of the portion that is contacted to the metal shell in the first molding becomes large, the first molding is contacted to the metal shell with a relatively large pressure and then the electrical conduction is more reliably performed from the first molding to the metal shell.

Next, after the temperature of the middle section is varied when the buckling deformation of the middle section is started, the clamping process is performed and the samples of the spark plug are prepared in groups of twenty respectively. Thus, regarding each of the samples that are prepared, each of the middle sections is observed and the cross-section shape of the middle section is specified. Here, in a case where the middle sections bulge toward both the inside and the outside in the diametrical direction at all of twenty samples, an evaluation of "◎" is decided on, and in a case where the middle section bulges both into the inside and to the outside in the diametrical direction at half or more of twenty samples, an evaluation of "○" is decided on. Meanwhile, in a case where the discharge is generated between the first molding and the metal shell, the clamping process is difficult so that an evaluation of "Δ" is decided on. Also, in the test, the biasing force is controlled so as to satisfy P<Q by the servo press and the temperature in which the deformation of the middle section is started is changed. In Table 8, the temperature and evaluation of the middle section, and P and Q that are set corresponding to the temperature of the middle section.

TABLE 8

| Middle Section Temperature(° C.) | Evaluation | P(N) | Q(N) |
|---|---|---|---|
| 30 | ○ | $1.80 \times 10^3$ | $2.20 \times 10^3$ |
| 100 | ○ | $1.70 \times 10^3$ | $2.20 \times 10^3$ |
| 250 | ○ | $1.40 \times 10^3$ | $2.20 \times 10^3$ |
| 350 | ◎ | $1.10 \times 10^3$ | $2.20 \times 10^3$ |
| 550 | ◎ | $0.60 \times 10^3$ | $2.20 \times 10^3$ |
| 750 | ◎ | $0.30 \times 10^3$ | $2.20 \times 10^3$ |
| 1000 | ◎ | $0.25 \times 10^3$ | $2.20 \times 10^3$ |
| 1050 | ◎ | $0.22 \times 10^3$ | $2.20 \times 10^3$ |
| 1100 | ◎ | $0.20 \times 10^3$ | $2.20 \times 10^3$ |
| 1150 | Δ | $0.19 \times 10^3$ | $2.20 \times 10^3$ |

As shown in FIG. 8, the temperature of the middle section is 350° C. or more when the buckling deformation is started, so that the middle sections can further reliably bulge toward both the inside and the outside in the diametrical direction. Meanwhile, if the temperature of the middle section is more than 1100° C. when the buckling deformation is started, it is clear that the electrical conduction is generated. This is assumed to be because the temperature of the middle section is more than 1100° C. when the buckling deformation is started, the pressure is required to be small when the deformation is started and then the closed contact between the molding and the metal shell becomes worse so that large current is necessarily applied with respect to the metal shell. As a result, it is assumed that discharge between the first molding and the metal shell is easily generated.

As described above, considering the result of the tests, it is preferable that the size of the biasing force P and the first molding is set so as to $P/S \geqq 5$ ($N/mm^2$) and the temperature of the middle section is 350° C. or more to 1100° C. or less when the deformation is started so that the middle section is reliably formed in a desired shape.

Also, the invention is not limited to the above-described embodiments; for example, examples may be included as below. Of course, applications and modified examples other than the examples may also be applied to the invention.

(a) In the above-described embodiments, the temperature of the middle section 41 is 350° C. or more to 1100° C. or less when the deformation is started, however the temperature of the middle section 41 when the deformation is started is not limited to them. Also, in the embodiments, the heating by the electrical conduction is performed so that the deformation amount of the middle section 41 along the axis CL1 becomes 0.2 mm or more to 1.0 mm or less and the highest temperature of the middle section 41 reaches 600° C. or more to 1300° C. or less, however the deformation amount of the middle section 41 along the axis CL1 and the highest temperature of the middle section 41 is not limited to the above-described ranges.

(b) In the above-described embodiments, the biasing force that is applied from both molds 51 and 52 to the metal shell 3 is controlled based on the deformation amount of the middle section 41 along the axis CL1, however the control unit of the biasing force is not limited to the above description.

(c) In the above-described embodiments, the cross-sectional area H of the smaller side in the cross-sectional area of the first slender section 43 and the cross-sectional area of the second slender section 44 is 35 $mm^2$ or less according to the tendency of the small diameter of the spark plug 1, however the cross-sectional area of the slender sections 43 and 44 are not specifically limited. According to the invention, even in a case where the cross-sectional areas of the slender sections 43 and 44 are relatively large, the generation of stress corrosion cracking can be effectively prevented.

(d) In the above-described embodiments, the invention is embodied in a case where the ground electrode 27 is welded at the leading end section 26 of the metal shell 3, however the invention may apply even to a case where a portion of the metal shell (or a portion of the leading end metal fitting that is welded beforehand to the metal shell) is cutout and then the ground electrode is formed (for example, JP-A-2006-236906 or the like).

(e) In the above-described embodiments, the tool engaging section 19 has a cross-section in a hexagonal shape, however the invention is not limited to the above-described shape regarding the shape of the tool engaging section 19. For example, a Bi-HEX (deformed 12 angles) shape [ISO22977: 2005(E)] may be applied.

REFERENCE SIGNS LIST

| | |
|---|---|
| 1: | SPARK PLUG (SPARK PLUG FOR INTERNAL COMBUSTION ENGINE) |
| 2: | INSULATING BODY (INSULATOR) |
| 3: | METAL SHELL |
| 16: | COLLAR SECTION |
| 19: | TOOL ENGAGING SECTION |
| 20: | CLAMPING SECTION |
| 41: | MIDDLE SECTION |
| 42: | BULGED SECTION |
| 42M: | MOST BULGED SECTION |
| 43: | FIRST SLENDER SECTION |
| 44: | SECOND SLENDER SECTION |
| 51: | FIRST MOLD (MOLDING) |
| CL1: | AXIS |

The invention claimed is:

1. A spark plug for an internal combustion engine comprising:

a cylindrical insulating body that extends in an axis direction; and a cylindrical metal shell that is fixed on an outer periphery of the insulating body, wherein the metal shell includes:

a collar section that bulges toward an outside of a diametrical direction, a tool engaging section to which a tool is engaged to attach the metal shell to the internal combustion engine, and a middle section that is positioned between the collar section and the tool engaging section, wherein the middle section has a bulged section that bulges toward both an inside and the outside in the diametrical direction, wherein the middle section has a first slender section that is a portion positioned at further rear end side in the axis direction than the bulged section and is a section that is the most slender in the portion, and a second slender section that is a portion positioned at further leading end side in the axis direction than the bulged section of the middle section and is a section that is the most slender in the portion, wherein the bulged section has a most bulged section that is a portion that bulges furthest to the inside in the diametrical direction, wherein in a cross-section including the axis, assuming that F (mm) is a distance between the first slender section and the second slender section along the axis, and G (mm) is a bulged amount toward the inside in diametrical direction of the most bulged section with respect to an imaginary line that connects a portion that is positioned furthest to the inside in the diametrical direction of the first slender section and a portion that is positioned furthest to the inside in the diametrical direction of the second slender section, following formula (1) is satisfied:

$$0.00<G/F\leqq 0.18 \quad (1).$$

2. The spark plug for the internal combustion engine according to claim 1, wherein $0.00<G/F\leqq 0.15$ is satisfied.

3. The spark plug for the internal combustion engine according to claim 1, wherein assuming that E1 (Hv) is a Vickers hardness of the first slender section, E2 (Hv) is a Vickers hardness of the second slender section and E3 (Hv) is a Vickers hardness of the most bulged section, any one of following formulas (2) and (3) is satisfied:

$$20\leqq|E1-E3| \quad (2)$$

$$20\leqq|E2-E3| \quad (3).$$

4. The spark plug for the internal combustion engine according claim 1, wherein in a cross-section that is orthogonal to the axis, assuming that a cross-sectional area of a smaller side in a cross-sectional area of the first slender section and a cross-sectional area of the second slender section is H ($mm^2$), $H\leqq 35$.

5. The spark plug for the internal combustion engine according to claim 4, wherein $H\leqq 31.2$.

6. The spark plug for the internal combustion engine according to claim 4, wherein $H\leqq 26.4$.

7. The spark plug for the internal combustion engine according to claim 4, wherein $H\leqq 19.4$.

8. A method of manufacturing a spark plug comprising:

a cylindrical insulating body that extends in an axis direction; and a cylindrical metal shell that is fixed on an outer periphery of the insulating body, wherein the metal shell includes a middle section that has a curved shape outer periphery that bulges to an outside in a diametrical direction, the method comprising:

when the insulating body and the metal shell are fixed to each other, applying a biasing force with respect to a rear end side of the metal shell along the axis direction in a state where the insulating body passes through the metal shell; heating at least the middle section by electrical conduction; contracting, crushing and deforming the middle section; bending a rear end opening of the metal shell into an inside in the diametrical direction; forming a clamping section; and fixing the insulating body and the metal shell to each other;

in the biasing force, wherein assuming that Q(N) is the biasing force when a temperature of the portion that is the most bulged to the outside in diametrical direction of the middle section reaches 600° C., and P(N) is the biasing force when a current value that is 50% of the current value applied to the middle section when the portion reaches 600° C., in a prior step in which the temperature of the portion reaches 600° C., $P<Q$ is satisfied.

9. The method of manufacturing the spark plug according to claim 8, wherein $P\leqq 0.8Q$ is satisfied.

10. The method of manufacturing a spark plug according to claim 8, wherein the temperature of the middle section is 350° C. to 1100° C. when the deformation of the middle section is started.

11. The method of manufacturing the spark plug according to claim 8, wherein a cylindrical mold that has a curved surface corresponding to the clamping section is moved along the axis so that the biasing force is applied with respect to the rear end section of the metal shell, and assuming that a portion that is contacted to the metal shell in the mold is projected to a plane that is orthogonal to the axis and a projected area S ($mm^2$), $P/S\leqq 5$ ($N/mm^2$) is satisfied.

12. The method of manufacturing the spark plug according to claim 8, wherein a maximum temperature of the middle section is 600° C. to 1300° C. when heating is performed by the electrical conduction.

13. The method of manufacturing the spark plug according to claim 8, wherein a deformation amount of the middle section along the axis is 0.2 mm to 1.0 mm.

14. The method of manufacturing the spark plug according to claim 8, wherein the biasing force that is applied to the rear end section of the metal shell is controlled based on the deformation amount of the middle section along the axis.

15. The method of manufacturing the spark plug according to claim 8, wherein a movement amount of jig that biases the rear end section of the metal shell along the axis is controlled based on the deformation amount of the middle section along the axis.

* * * * *